US007805964B2

(12) United States Patent
Park

(10) Patent No.: US 7,805,964 B2
(45) Date of Patent: Oct. 5, 2010

(54) DETERGENT SUPPLY APPARATUS OF WASHING MACHINE

(75) Inventor: Seon Ho Park, Buchun-si (KR)

(73) Assignee: LG Electronics Inc., Seoul (KR)

( * ) Notice: Subject to any disclaimer, the term of this patent is extended or adjusted under 35 U.S.C. 154(b) by 347 days.

(21) Appl. No.: 11/607,853

(22) Filed: Dec. 4, 2006

(65) Prior Publication Data

US 2007/0125134 A1 Jun. 7, 2007

(30) Foreign Application Priority Data

Dec. 6, 2005 (KR) ..... 10-2005-0118259

(51) Int. Cl.
*D06F 29/00* (2006.01)
*D06F 35/00* (2006.01)
*D06F 39/04* (2006.01)
*D06F 39/08* (2006.01)

(52) U.S. Cl. ..... 68/17 R; 68/12.18; 68/19; 8/158; 8/159

(58) Field of Classification Search ..... 68/17 R
See application file for complete search history.

(56) References Cited

U.S. PATENT DOCUMENTS 6,434,977 B1 * 8/2002 Hapke et al. ..... 68/17 R
2003/0145633 A1 * 8/2003 Merkle et al. ..... 68/17 R
2004/0000177 A1 * 1/2004 Maeng ..... 68/17 R
2004/0172770 A1 * 9/2004 Heo et al. ..... 8/158
2005/0241072 A1 * 11/2005 Kim et al. ..... 8/158

FOREIGN PATENT DOCUMENTS

DE 195 95 292 A1 2/1995

OTHER PUBLICATIONS

German office Action dated Mar. 26, 2010 with English Translation.

* cited by examiner

*Primary Examiner*—Michael Barr
*Assistant Examiner*—Jason Y Ko
(74) *Attorney, Agent, or Firm*—KED & Associates LLP

(57) ABSTRACT

In a detergent supply apparatus of a drum-type washing machine according to the present invention, detergent supplying units and a softener supplying unit are partitioned and provided in a detergent box and the softener supplying unit is provided with a siphon tube, a siphon cap having an outlet path formed between the siphon tube and the siphon cap is provided with a softener supplying unit, and the softener injecting unit 286 is opened and closed by a softener lid, making it possible to prevent detergent from infiltrating into the inside of the softener supplying unit through the softener supplying unit.

25 Claims, 7 Drawing Sheets

DETERGENT SUPPLY APPARATUS OF WASHING MACHINE

This Nonprovisional application claims priority under 35 U.S.C. §119(a) on Patent Application No. 10-2005-0118259 filed in Korea on Dec. 6, 2005, the entire contents of which are hereby incorporated by reference.

BACKGROUND

1. Field of the Invention

The present invention relates to a detergent supply apparatus of a washing machine housing and supplying detergent and softener, etc., and more particularly, to a detergent supply apparatus of a washing machine preventing detergent from being infiltrated into a softener supplying unit.

2. Discussion of Related Art

In general, a washing machine refers to a device for cleaning a laundry through washing, rinsing, dewatering, and drying to decontaminate clothes and bedclothes (Hereinafter, referred to as "laundry").

The washing machine is provided with a detergent supply apparatus for housing detergent and softener, etc. and then, selectively supplying the detergent, and the softener, etc. at a necessary time.

The detergent supply apparatus is arranged at a water supply passage of the washing machine, so that detergent and softener are mixed and supplied with water passing through the water supply passage of the washing machine, and the whole or the part thereof is formed to be drawn or disengaged outside so that the detergent and the softener can be put therein.

However, the detergent supply apparatus according to the prior art having the above-described structure has problems that, when detergent is put therein or water is supplied to a detergent supplying unit, the detergent spatters on a softener supplying unit so that it may be infiltrated or overflowed to the softener supplying unit, and when the softener is supplied, the detergent is supplied together with the softener so that a rinsing performance thereof may be deteriorated.

SUMMARY OF THE INVENTION

Accordingly, the present invention is to solve at least the problems and disadvantages of the background art.

The present invention is to provide a detergent supply apparatus of a washing machine capable of preventing detergent from being infiltrated into the inside of a softener supplying unit.

To achieve these and other advantages and in accordance with the purpose of the present invention, there is provided a detergent supply apparatus of a drum-type washing machine. The apparatus includes a detergent box in which a detergent supplying unit and a softener supplying unit are partitioned and formed, the softener supplying unit being provided with a siphon tube; a siphon cap having an outlet path formed between the siphon tube and the siphon cap and provided with a detergent injecting unit; and a softener lid opening and closing the softener injecting unit.

The detergent box is formed so that the detergent supplying unit includes a main detergent supplying unit and a preliminary detergent supplying unit, and the softener supplying unit is positioned between the main detergent supplying unit and the preliminary detergent supplying unit.

The siphon cap includes a cover covering the whole top of the softener supplying unit and a cap unit protruded from the bottom surface of the cover to surround the siphon tube.

The cover is provided with a water supplying unit for supplying water to the softener supplying unit.

The cap unit of the siphon cap is protruded in a position between the softener injecting unit and the water supplying unit.

The softener lid is hinge-connected to the siphon cap.

A hinge axis is provided on one side of the softener lid and the siphon cap, and an axis supporting unit for rotatably supporting the hinge axis is provided on the other side thereof.

The softener lid is provided with a handle.

A rib is provided on one side of the softener lid and the siphon cap, and a detachable unit inserting and drawing the rib is provided on the other side thereof.

The rib is protrudingly provided on the softener lid.

The detachable unit is provided on the top of the siphon cap.

The siphon cap is provided with a handle groove around the detachable unit in order for a user to easily grasp the surroundings of the rib by his own hand.

A detergent supply apparatus of a washing machine according to the present invention includes a detergent box in which a detergent supplying unit and a softener supplying unit are partitioned and formed, the softener supplying unit being provided with a siphon tube; a siphon cap having an outlet path formed between the siphon tube and the siphon cap; a softener cover covering the top of the softener supplying unit and provided with a softener injecting unit and a water supplying unit; and a softener lid opening and closing the softener injecting unit.

The softener cover is provided with a water supplying unit.

The softener cover is hinge-connected to the softener cover.

A rib is provided on one side of the softener lid and the softener cover, and a detachable unit inserting and drawing the rib is provided on the other side thereof.

In the detergent supply apparatus of the washing machine according to the present invention having the above-described structure, the softener lid opens and closes the softener injecting unit formed on the siphon, so that the detergent can be prevented from being infiltrated through the softener injecting unit of the siphon cap.

Also, in the detergent supply apparatus of the washing machine according to the present invention, the softener lid is hinge-connected to the siphon cap, so that the softener injecting unit can be opened and closed by means of a simple movement to lift up or down the softener lid, having an advantage of easiness in an opening and closing movement.

Also, in the detergent supply apparatus of the washing machine according to the present invention, the rib is provided on one side of the softener lid and the siphon cap and the detachable unit detaching the rib is provided on the siphon cap, so that the manufacturing thereof is easy.

Also, in the detergent supply apparatus of the washing machine according to the present invention, the softener lid or the siphon cap is provided with the handle, so that the operation thereof is easy in opening and closing the softener lid.

BRIEF DESCRIPTION OF THE DRAWINGS

A more compete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Hereinafter, one embodiment of a laundry treatment apparatus according to the present invention will be described with reference to the drawings.

Figure 1:
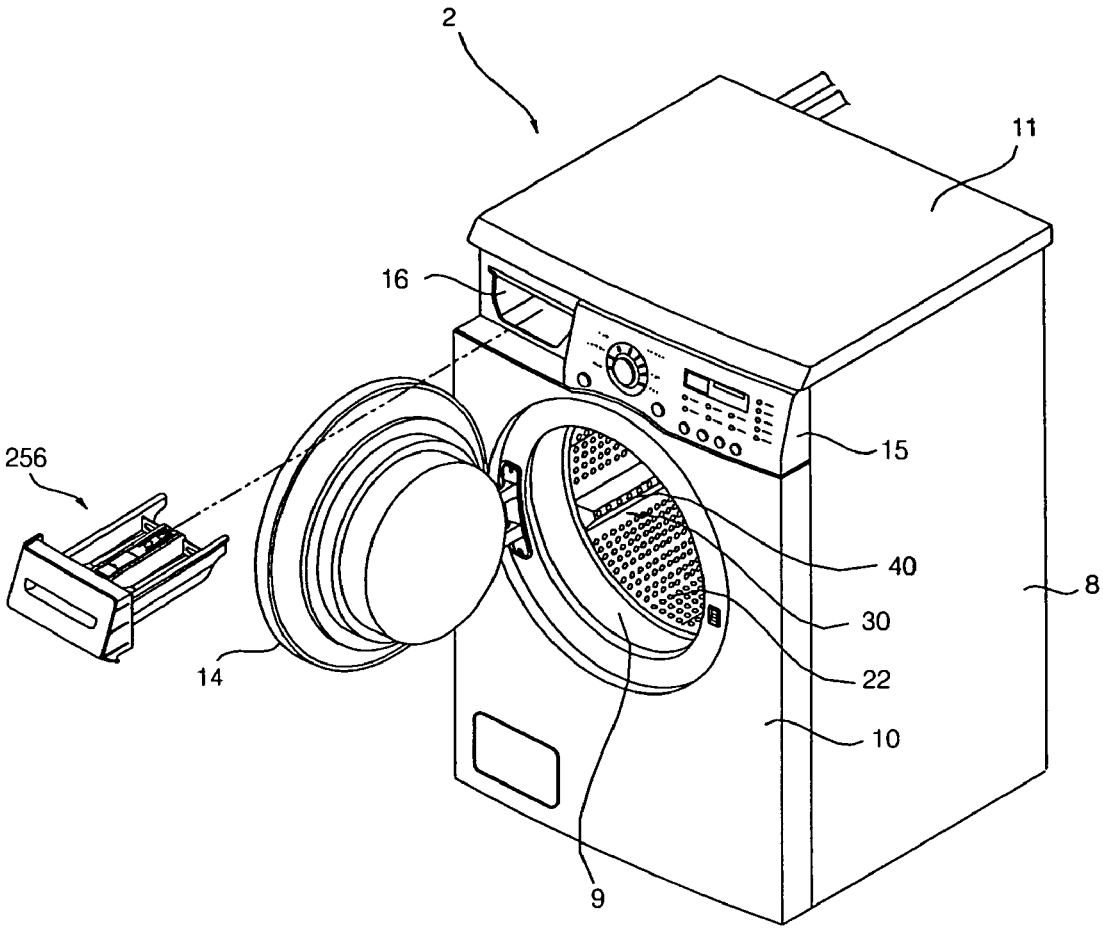
FIG. 1 is a perspective view showing a drum-type washing machine applied with a detergent supply apparatus of a washing machine according to a first embodiment of the present invention.
Figure 2:
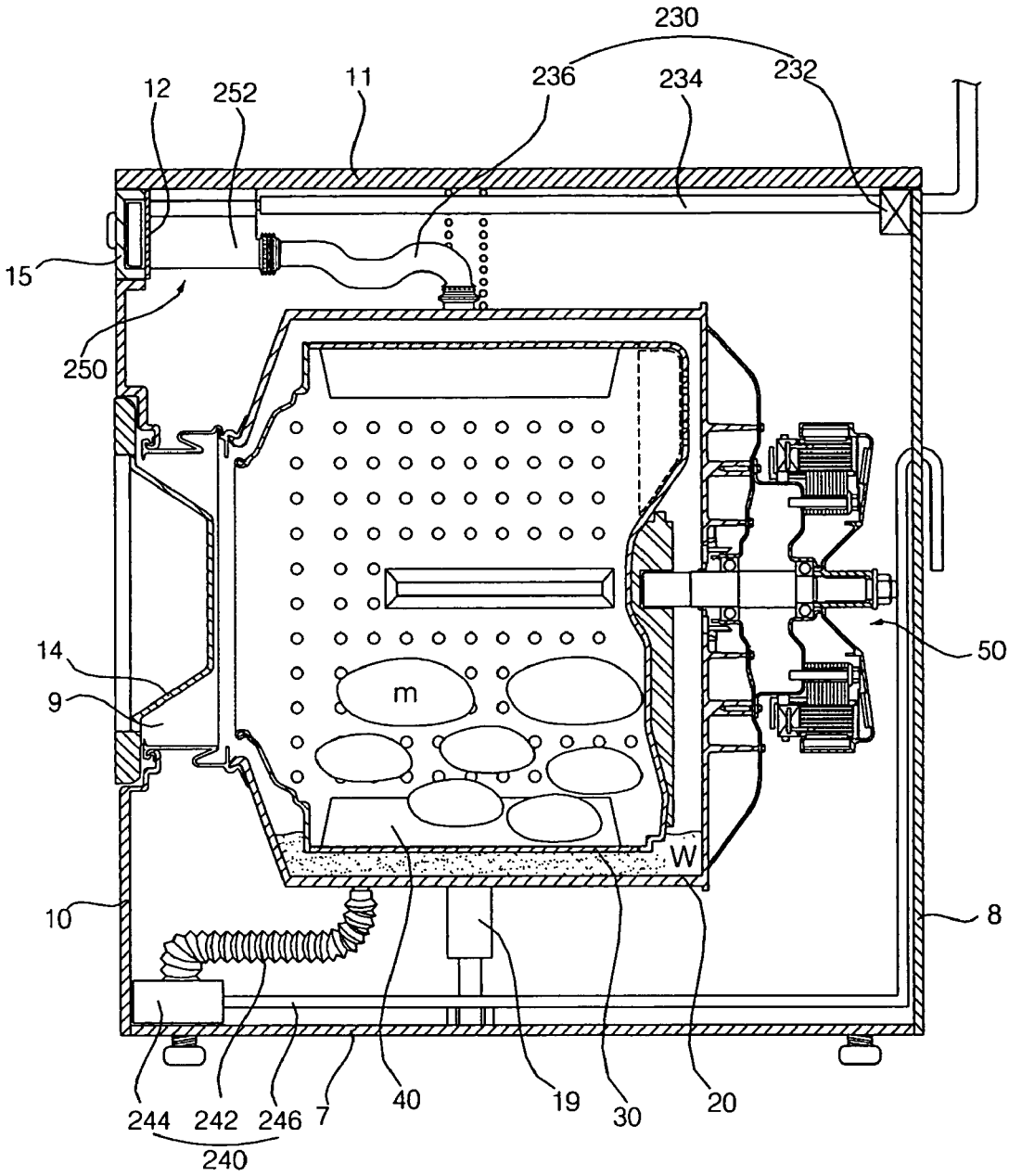
FIG. 2 is a cross-sectional view showing the internal structure of the drum-type washing machine as shown in FIG. 1.
Figure 3:
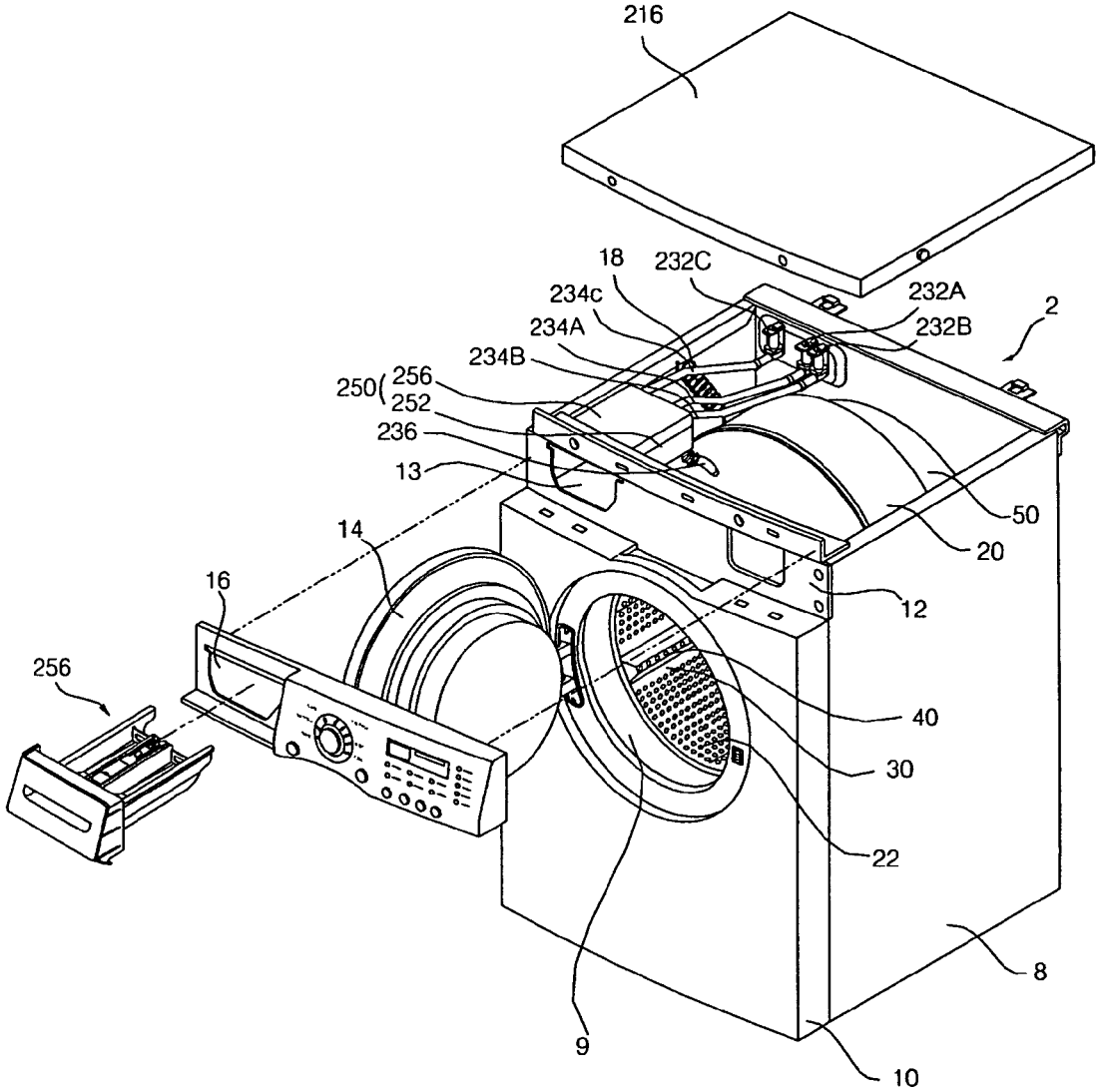
FIG. 3 is an exploded perspective view of a main part of the drum-type washing machine as shown in FIG. 1.

FIG. 1 is a perspective view showing a drum-type washing machine applied with a detergent supply apparatus of a washing machine according to a first embodiment of the present invention, FIG. 2 is a cross-sectional view showing the internal structure of the drum-type washing machine as shown in FIG. 1, and FIG. 3 is an exploded perspective view of a main part of the drum-type washing machine as shown in FIG. 1.

The present embodiment will now be described with reference to FIGS. 1 to 3. The drum-type washing machine as shown in FIG. 1 includes a casing 2 forming an appearance; a tub 20 installed in an inner side of the casing 2 such that it can be buffered by a spring 18 and a damper 19; a drum 30 rotatably disposed in an inner side of the tub 20 and having a plurality of water holes 22; a lifter 40 installed on an inner circumference surface of the drum 30 and lifting up the laundry by a predetermined height so that the laundry can fall by gravity; and a motor 50 installed in the rear of the tub 20 and rotating the drum 30.

The casing 2 includes a base 7; a cabinet 8 installed at the top side of the base 7 to form the appearance on the right and left surfaces and the back surface of the drum-type washing machine 1; a cabinet cover 10 installed in front of the cabinet 8 and having a water doorway 9 in the center thereof; and a top plate 11 installed at the top of the cabinet 8.

A support frame 12 formed long from left to right is mounted in the front top side of the cabinet 8, and supports the right and left surfaces of the cabinet 8.

An insertion hole 13 is provided in the support frame 12 to be opened back and forth to insert the front end of a dispenser housing 252 to be described later.

A door 14 for opening and closing the water doorway 9 is rotatably installed in the cabinet cover 10.

A control panel 15 is installed at the top side of the cabinet cover 10 to display an operation state of the drum-type washing machine and control an operation of the drum-type washing machine.

An opening 16 is provided in the control panel 15 to be opened back and forth to allow entrance and exit of the drawer 254 described later.

A water supplying unit 230 is installed at the top side of the tub 20.

The water supplying unit 230 includes a water supplying valve 232 for controlling water supplied from an external water source; a water supplying hose 234 for guiding the water passing through the water supplying valve 232; the detergent supply apparatus 250 for mixing the water guided by the water supplying hose 234, with one of detergent and softener, and discharging the mixture; and a water supplying bellows 236 for guiding and supplying the water, which passes through the detergent supply apparatus 250 and is mixed with the detergent and the like, into the tub 20. Parts of the water supplying valve 232, the water supplying hose 234, and the detergent supply apparatus 250, and the water supplying bellows 236 constitute a water supply passage of the washing machine.

The water supplying valve 232 is installed to pass through the back surface of the cabinet 8 in the top of the cabinet 8. The water supplying valve 232 includes cool water valves 232A and 232B for introducing cool water from the exterior, and a hot water valve 232C for introducing hot water from the exterior.

The detergent supply apparatus 250 is installed to communicate between the water supplying hose 234 and the water supplying bellows 236, thereby supplying the detergent, together with the water supplied from the water supplying unit 230, to the tub 20.

The water supplying hose 234 is installed between the water supplying valve 232 and the detergent supply apparatus 250 to guide the water to the detergent supply apparatus 250. The water supplying hose 234 includes first and second cool water hoses 234A and 234B connecting between the cool water valves 232A and 232B and the detergent supply apparatus 250; and a hot water hose 234C connecting between the hot water valve 232C and the detergent supply apparatus 250.

Figure 4:
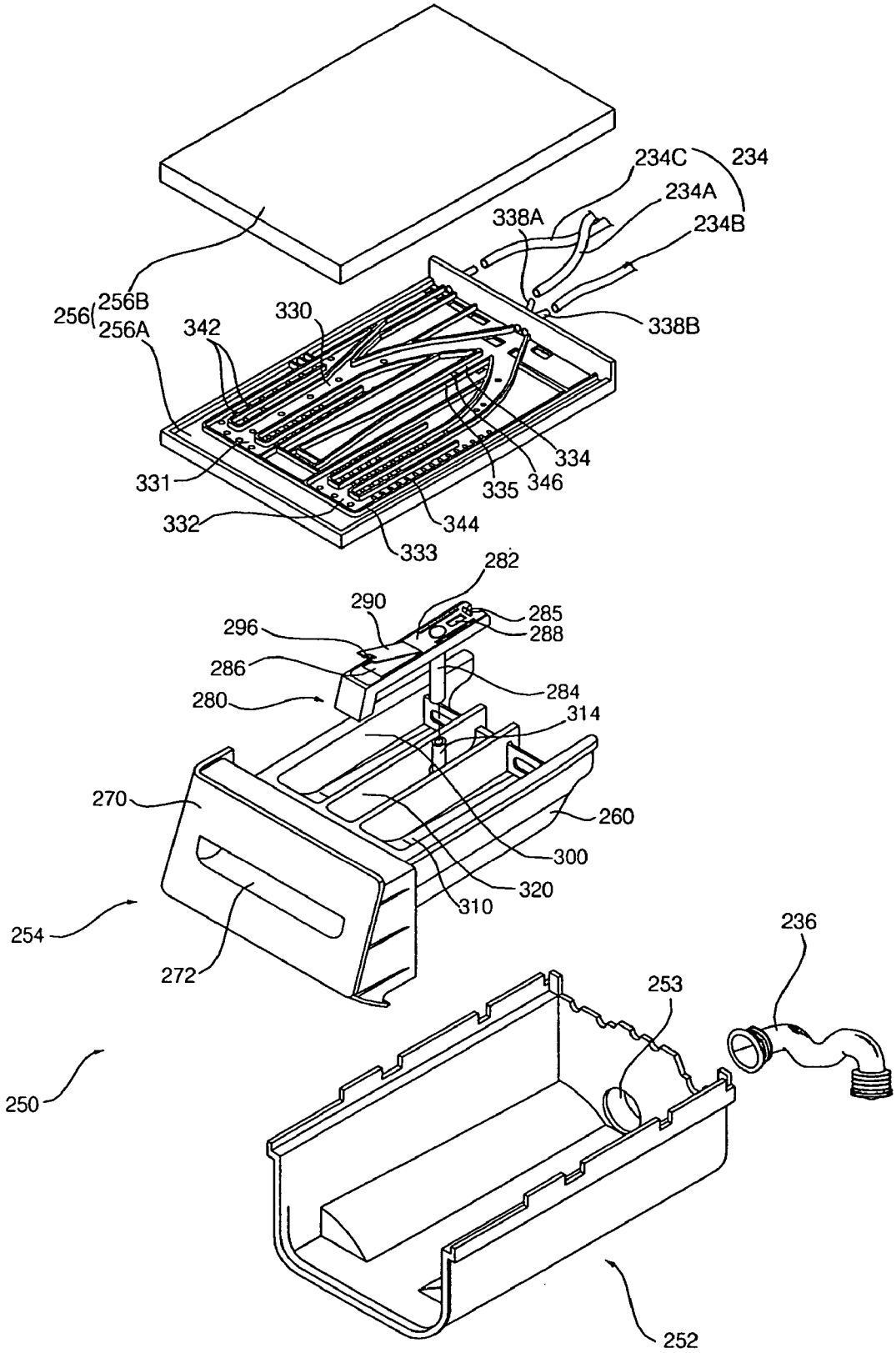
FIG. 4 is an exploded perspective view showing the detergent supply apparatus as shown in FIGS. 2 and 3.

As illustrated in FIG. 4, a water draining unit 240 is installed at the bottom side of the tub 20 to discharge a washing water used for washing and rinsing, and water dewatered from a bag (Hereinafter, referred to as "washing water"), to the exterior of the commercial drum-type washing machine.

The water draining unit 240 includes a water draining bellows 242 connected to a water draining port of the tub 20; a water draining pump 244 connected to the water draining bellows 242; and a water draining hose 246 for guiding the washing water pumped by the water draining pump, to the exterior of the drum-type washing machine.

Figure 5:
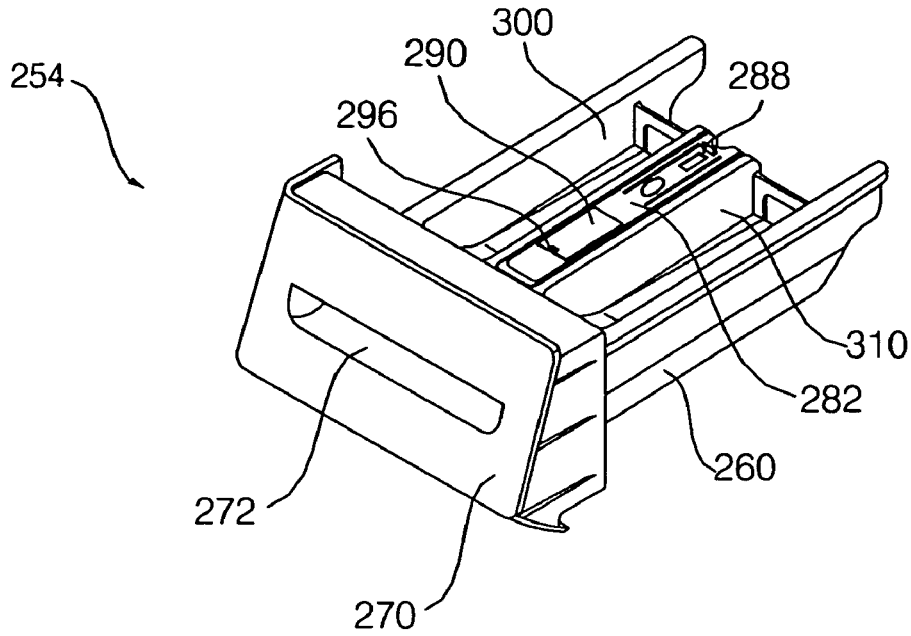
FIG. 5 is an enlarged perspective view showing a state that a siphon cap is coupled to a detergent box in FIG. 4.
Figure 6:
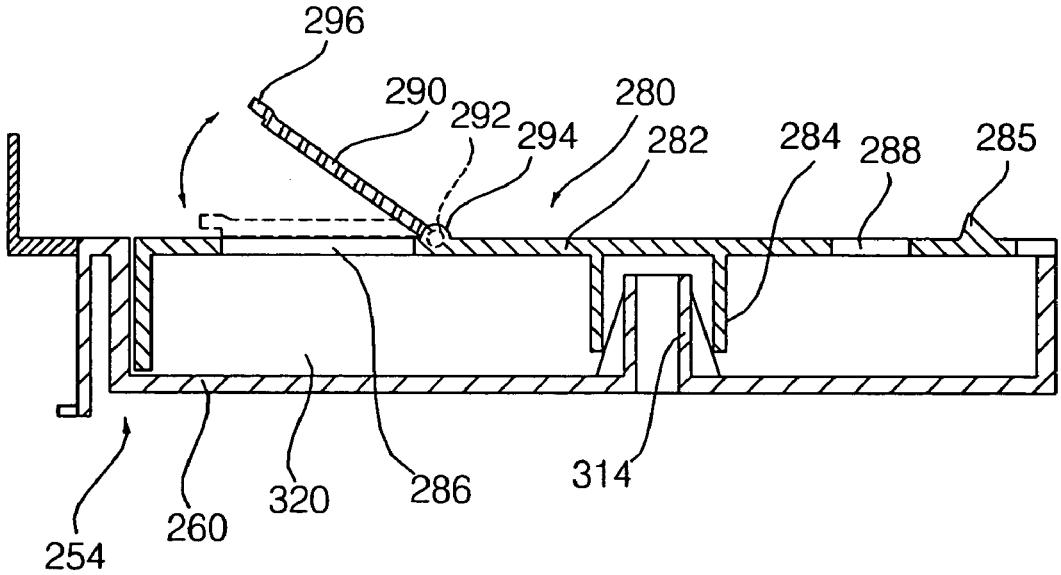
FIG. 6 is a cross-sectional view showing the detergent supply apparatus as shown in FIG. 5.

FIG. 4 is an exploded perspective view showing the detergent supply apparatus as shown in FIG. 3, FIG. 5 is an enlarged perspective view showing a state that a siphon cap is coupled to a detergent box in FIG. 4., and FIG. 6 is a cross-sectional view showing the detergent supply apparatus as shown in FIG. 5.

As shown in FIG. 4, the detergent supply apparatus 250 includes a dispenser housing 252 connected to the water supplying bellows 236 and opened at the front top thereof; a detergent box 254 for housing and supplying the detergent and the softener, etc.; a dispenser cover 256 provided on the opened top of the dispenser housing 252, communicating with and connected to the water supplying hose 234, and supplying water into the detergent box 254.

A water draining port 253 is protruded from the dispenser housing 252 to be connected to the water supplying bellows 236 such that a mixture liquid of detergent and water dropping from the drawer 254 can be supplied inside the tub 20.

The detergent box 254 is inserted into the dispenser housing 252 that is the water supply passage of the washing machine so that it is disposed in the water supply passage of the washing machine or is drawn to the exterior.

The detergent box 254 includes a drawer 260 provided to house and supply the detergent and the softener, etc.; and a drawer panel 270 coupled with the front surface of the drawer 260 and having a handle 272 in the front thereof.

The detergent box 254, specifically, the drawer 260 includes detergent supplying units 300 and 301 for housing and supplying the detergent; and a softener supplying unit 310 for housing and supplying the softener.

In the drawer 260, the detergent supplying units 300 and 310 is configured of a main supplying unit 310 and a preliminary detergent supplying unit 320, and the softener supplying unit 330 is partitioned to be positioned between the main detergent supplying unit 310 and the preliminary detergent supplying unit 320.

The main detergent supplying unit 310, the softener supplying unit 330 and the preliminary detergent supplying unit 320 each are formed to have a box shape opened at the top thereof and to be long back and forth.

Meanwhile, a predetermined height of a siphon tube 314 communicating with the bottom of the drawer 254 is formed to be protruded approximately in the back of the softener supplying unit 310.

And, a siphon cap 280 having an outlet path formed between the siphon tube 314 and the siphon cap 280 is disposed in the detergent box 256.

The siphon cap 280 includes a cover 282 covering the whole of the top of the softener supplying unit 310; and a cap unit 284 protruded at the part corresponding to the siphon tube 314 among the bottom surfaces to surround the exterior circumference of the siphon tube 314.

Here, when the cover 282 is smaller than the top of the softener supplying unit 310, the detergent or the water spattered from the main detergent supplying unit 300 and the preliminary detergent supplying unit 310 may be infiltrated through a gap between the cover 282 and the softener supplying unit 310. When the cover 282 is formed in a size and a shape to cover all the top of the softener supplying unit, it functions as a sort of softener cover preventing the detergent or the water spattered from the main detergent supplying unit 300 and the preliminary detergent supplying unit 310 from being infiltrated through a gap between the cover 282 and the softener supplying unit 310.

The cover 282 is provided with a stumbling jaw stumbled on a protrusion (not shown) formed in the bottom surface of the dispenser cover 256 in a front direction, when drawing the detergent box.

The stumbling jaw 285 is a sort of stopper drawing only a part rather than the whole of the detergent box 254, when generally drawing the detergent box 254.

And, the cover 282 is provided with a softener injecting unit 286 and a water supplying unit 288 capable of injecting detergent and supplying water, respectively, with the siphon cap 280 mounted on the detergent box 254.

Preferably, the detergent box 254 of which softener injecting unit 286 is formed in the siphon cap 280, especially, in front of the cover 286, so that softener may be injected in a state that a part of the detergent box 254 is drawn to the front.

And, preferably, in the detergent box 254 the water supplying unit 288 is formed to be separated from the softener supplying unit 320 at maximum so that the water supplied through the water supplying unit 288 is not flowed out through the softener injecting unit 286 after being spattered in the softener supplying unit 320. When the cap unit 284 is positioned between the bottom side of the water supplying unit 288 and the bottom side of the softener injecting unit 286, the water spattered from the softener supplying unit 230 is blocked by the cap unit 284 not to be face the softener injecting unit 286. Therefore, most preferably, the softener injecting unit 286, the cap unit 284 and the water supplying unit 288 are formed back and forth in sequence.

Also, when a user draws a part of the detergent box 254 to the front, preferably, the water supplying unit 288 is formed in a position not to be exposed to the exterior so that the detergent is not injected into the water supplying unit 288 of the siphon cap 280, and it is formed in the rear of the stumbling jaw 285 or in the front adjacent the stumbling jaw 285.

Meanwhile, the detergent supply apparatus 250 further includes a softener lid 290 opening and closing the softener injecting unit 286, since the detergent or the water spattered from the main detergent supplying unit 300 and the preliminary detergent supplying unit 310 may be infiltrated from the softener injecting unit 286 to softener supplying unit 320.

The softener lid 290 is a sort of door opening the softener injecting unit 286 when the detergent is injected into the softener supplying unit 320, and closing the softener injecting unit 286 when the detergent is not injected into the softener supplying unit 320. Preferably, the softener lid 290 is formed to be slid or rotated on the siphon cap 280 and most preferably, the softener lid is formed to be hinge-connected to the siphon cap 280 so as to make the opening and closing thereof easy and the softener lid not block the water supplying unit 235 when the softener injecting unit 264 is opened.

And, preferably, the back end side of the softener lid 290 is hinge-connected to the siphon cap 280 so that the softener injecting unit 264 does not disturb the injection of the detergent when the detergent injecting unit 286 is opened.

A hinge axis is formed on one side of the siphon cap 280 and the softener lid 290, and an axis supporting unit 294 for rotatably supporting the hinge axis 292 is formed on the other side. Hereinafter, the present invention will be described by defining that the hinge axis 282 is formed on the back end side of the softener lid 290, and the axis supporting unit 294 is formed on the cover 282 of the siphon cap 280.

Meanwhile, since the softener lid 230 is constituted in a structure that its front end side is stumbled by the front of the softener injecting unit 220 not to be rotated to the bottom of the softener injecting unit 220 so that the softener lid 230 is more long formed back and forth than the softener injecting unit 220.

And, the softener lid 290 is provided with a handle 296 so that a user and the like can easily grasp it when the softener lid 290 closes the softener injecting unit 286.

The handle 296 is formed to be step-jawed upwardly to a front end of a softener lid 290 facing a hinge axis 292.

Meanwhile, as shown in FIG. 4, the dispenser cover 256 includes a bottom panel 256A mounted at the opened top of the dispenser housing 252; and a top panel 256B up-mounted at the top of the bottom panel 256A to form the detergent water supply passages 330 and 332 and the softener water supply passage 334, together with the bottom panel 256A.

In the bottom panel 256A, a hose connection unit 338 connected to the water supplying hose 234 of the water supplying unit 230 is formed to be protruded from rear thereof.

The hose connection unit 338 includes the cool water hose connection units 338A and 338B connected to cool water hoses 234A and 234B for supplying cool water to the main detergent water supply passage 330, the softener water supply passage 334, and the preliminary detergent water supply passage 332 and a hot water hose connection unit 338C connected to a hot water hose 234C for supplying hot water to the main detergent water supply passage 330.

In the bottom panel 256A, a plurality of water supplying holes 340 are provided to face the detergent supplying unit 300, preliminary detergent supplying unit 310, and a softener supplying unit 310 of the detergent box 254.

The water supplying hole 340 includes a main detergent water supplying hole 342 provided at the top side of the detergent supplying unit 300 to supply the water within the main detergent water supply passage 330 to the detergent supplying unit 300; a preliminary detergent water supplying hole 344 provided at the top side of the preliminary detergent supplying unit 310 to supply water within the preliminary detergent water supply passage 332 to the preliminary detergent supplying unit 310; and a detergent water supplying hole 346 provided at the top side of the softener supplying unit 320 to supply water within the softener water supply passage 334 to the softener supplying unit 320.

A plurality of the main detergent water supplying holes 342 are provided to face an inner side surface of the detergent supplying unit 300, and the softener water supplying hole 346 is provided to face the water supplying unit 288 of the siphon cap.

The dispenser cover 256 flows cool water or hot water from the cool water hose connection units 338A and 338B and the hot water hose connection unit 338C to the main detergent water supplying hole 342 and flows cool water from the cool water hose connection units 338A and 338B to one of the main detergent water supplying hole 342, the preliminary detergent water supplying hole 344, and the softener water supplying hole 346. A detergent water supplying rib 331 forming the detergent water supply passage 330, a preliminary detergent water supplying rib 333 forming the preliminary detergent water supply passage 332, and a softener water supplying rib 335 forming the softener water supply passage 334 are formed to be projected from one of the top panel 256B and the bottom panel 256A.

An operation of the detergent supply apparatus of a washing machine according to the present embodiments having the above-described structure will now be described below.

First, when injecting detergent to the detergent box 254, a user draws forward the whole or a part of the detergent box 254 and puts detergent into the detergent supplying unit 300 or the preliminary supplying unit 310.

In a detergent injecting operation as above, a part of the detergent can fall into the detergent supplying unit 300, the detergent supplying unit 300 neighboring the preliminary detergent supplying unit 310, or the preliminary detergent supplying unit 310. However, since the top of the softener detergent accommodating unit 320 is clogged by the cover 282 of the siphon cap 280 and the softener injecting unit 286 of the siphon cap 280 is clogged by the softener lid 290, the detergent is not infiltrated into the inside of the preliminary detergent accommodating unit 320 and remains the top surface of the cover of the siphon cap 280 or the top surface of the softener lid 290.

Meanwhile, in the case where the softener is injected into the detergent box (254), if a user grasps and lifts up the handle 296 of the softener lid 290 by his own hand, the softener lid 290 is rotated upwardly to the center of the back end side and the softener injecting unit 286 is opened. If the user releases the grasped handle after injecting the softener through the opened softener injecting unit 286, the softener lid 290 is rotated downwardly by self weight and the softener injecting unit 286 is sealed by being covered by the softener lid 290.

After injecting the detergent and the softener as above, if the detergent box 254 is forcibly pushed into the inner side of the dispenser housing 252, in the detergent box 254, the detergent supplying unit 300, the preliminary detergent supplying unit 310, and the softener supplying unit 320 are positioned at the bottom side of the dispenser cover 256 in the state that the siphon cover 280 covers the softener supplying unit 320.

If the washing is progressed in the state that the detergent is fed into the preliminary detergent supplying unit 310 or the detergent supplying unit 300, the dispenser cover 256 supplies water toward the preliminary detergent supplying unit 310 or the detergent supplying unit 300, and the detergent is mixed with the sprayed water and they pass through the dispenser housing 252 and the water supplying bellows 236 in turn and then are supplied to the tub 20.

On the one hand, when water is supplied to the preliminary detergent supplying unit 310 or the detergent supplying unit 300, the detergent accommodated in the detergent supplying unit 300 or the preliminary detergent supplying unit 300 is spattered and overflowed together with water so that it can be moved to the top surface of the siphon cap 280. However, since the top surface of the softener supplying unit 320 is covered by the siphon cap 280 and the softener injecting unit 286 is sealed by the softener lid 290, they cannot be infiltrated into the inside of the softener supplying unit 310.

Meanwhile, in a rinsing process, in particular, a last rinsing process, the dispenser cover 256 supplies water toward the water supplying unit 288 of the siphon cap 280, and the softener is mixed with the supplied water and they are discharged into the bottom of the detergent box 254 by passing through the outlet path between the siphon tube 314 and the cap unit 284 by a siphon principle, and pass through the dispenser housing 252 and the water supplying bellows 236 in turn and then are supplied to the tub 20.

Figure 7:
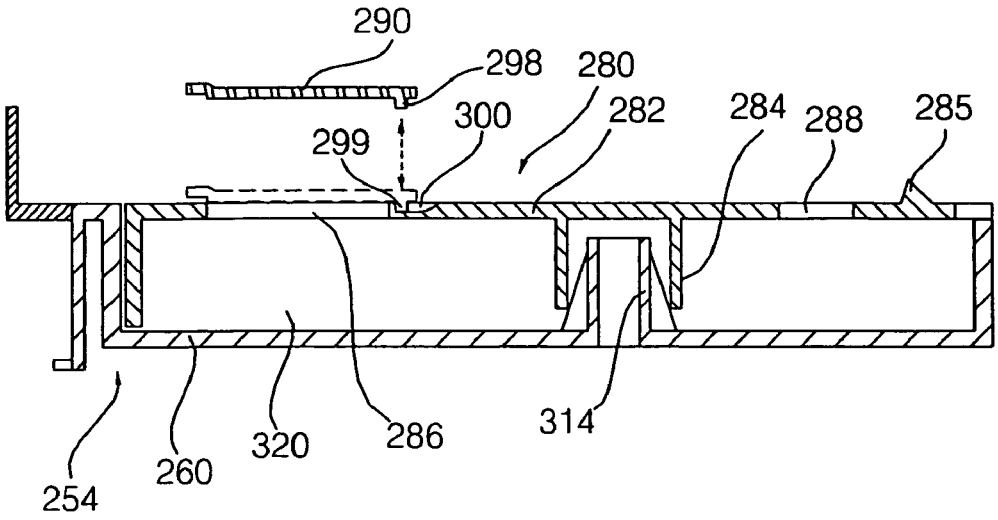
FIG. 7 is a cross-sectional view of the detergent supply apparatus according to a second embodiment of the present invention.

FIG. 7 is a cross-sectional view of a detergent supply apparatus of a washing machine according to a second embodiment of the present invention.

In the detergent supply apparatus of the washing machine according to the present embodiment, as shown in FIG. 7, the rib 298 is protruded downwardly to the bottom surface of the detergent lid 290 and the cover 282 of the siphon cap 280 is formed with a detachable unit 299 to insert and mount or draw and disengage the rib 298. Other constitutions are the same as those of the first embodiment of the present invention and therefore, the components thereof are denoted by the same numerals and the detailed description thereof will be omitted.

The detachable unit 299 is the same as the rib 298 in shape; however, it is formed of a slightly larger groove or a hole in size.

Herein, in the detergent supply apparatus, the rib 298 is protruded upwardly to the cover 282 of the siphon cap 280. Also, the softener lid 290 may be provided with the detachable unit 299.

On the one hand, the cover 282 of the siphon cap 280 is provided with a hollow handle groove 300 in order for a user to easily grasp a circumference of the rib 298 by his own hand. In the detergent supply apparatus of the drum-type washing machine according to the present invention, if a user lifts up the detergent lid 290 when the detergent is supplied, the rib 298 releases from the detachable unit 299 of the siphon cap 280 so that the softener lid 29 is separated from the siphon cap 290, resulting in that the softener is supplied to the softener injecting unit 286.

Next, when inserting the rib 298 into the detachable unit 299 while putting the softener lid 290 on the siphon cap 280, the rib 298 is locked to the detachable unit 299 and the softener injecting unit 286 is sealed by being covered by the softener lid 290.

Figure 8:
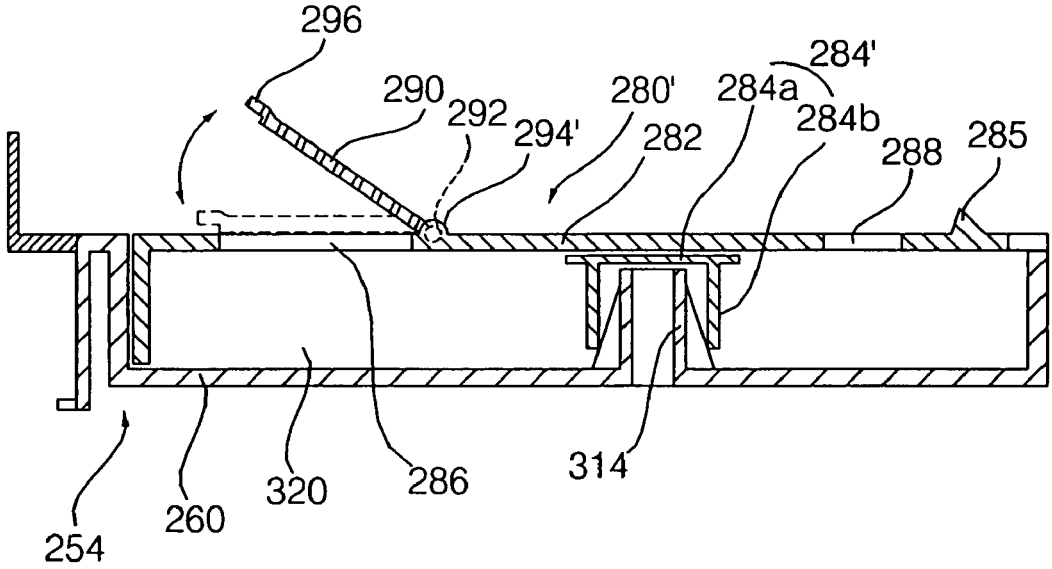
FIG. 8 is a cross-sectional view of the detergent supply apparatus according to a third embodiment of the present invention.

FIG. 8 is a cross-sectional view of a third embodiment of a detergent supply apparatus of a washing machine according to the present invention.

In the detergent supply apparatus of the washing machine according to the present embodiment, as shown in FIG. 8, a siphon cap 284' does not cover the whole top of the softener supplying unit 320 and a detergent cover 280' separately molded from the siphon cap 284' covers the whole top of the softener supplying unit 320. Other constitutions are the same as those of the first embodiment and the second embodiment of the present invention and therefore, the components thereof are denoted by the same numerals and the detailed description thereof will be omitted.

In other words, the detergent supplying units 300 and 310 and the softener supplying unit 320 are partitioned and formed in the detergent box 254, and the softener supplying unit 320 is provided with the siphon tube 314.

The siphon cap 284' is configured of a top surface 284*a* spaced from the top of the siphon tube 314 and a circumference 284*b* that surrounds the circumference of the siphon tube 314 and allows its bottom end to be spaced from the bottom surface of the softener supplying unit 320.

The top surface of the siphon cap 284' is disposed at a lower height than the top of the softener supplying unit 320.

And, the softener cover 280' is provided with the softener injecting unit 286 and the water supplying unit 288, and the softener cover 280' is provide with the softener lid 290 rotatably or detachably, which opens and closes the softener injecting unit 286.

In other words, the softener cover 280' according to the present invention is configured of a structure that the softener cover 280' is hinge-connected or detached, unlike the first embodiment or the second embodiment of the present invention. In the case where the softener cover 280' is hinge-connected or detached, a hinge axis is formed on one side of the softener cover 280' and a softener lid 290, an axis supporting unit 294' for rotatably supporting the hinge axis 292 is formed on other side thereof. In the case where the softener cover is detachably connected, a rib (not shown) is formed on one side of the softener cover 280' and the softener lid 290 and a detachable unit 299 is formed on other side thereof to insert and draw the rib (not shown).

Figure 9:
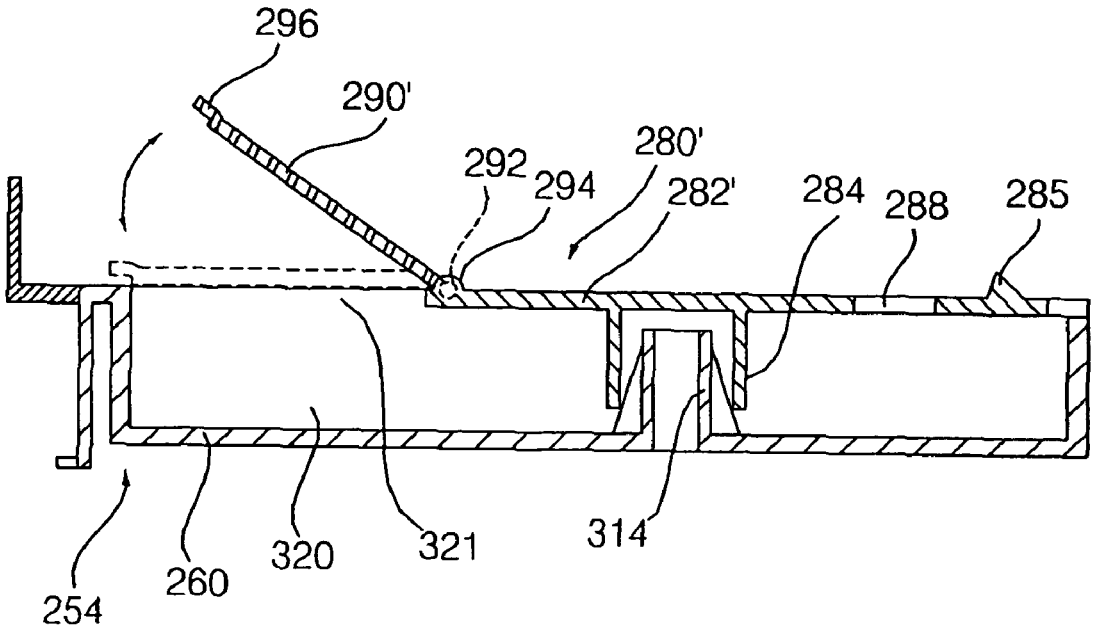
FIG. 9 is a cross-sectional view of the detergent supply apparatus according to a fourth embodiment of the present invention.

FIG. 9 is a cross-sectional view of a fourth embodiment of a detergent supply apparatus of a washing machine according to the present invention.

In the detergent supply apparatus of the washing machine according to the present invention, as shown in FIG. 9, a cover 282', which is the top of a siphon cap 280', covers a part of the softener supplying unit 320 and the softener lid 290' opens and closes a gap 321 between the top of the softener supplying unit 320 and the top of the siphon cap 280. Other constitutions are the same as those of the first embodiment and the second embodiment of the present invention and therefore, the components thereof are denoted by the same numerals and the detailed description thereof will be omitted.

In order words, the detergent supplying units 300 and 310 and the softener supplying unit 320 are partitioned and formed in the detergent box 254, and the softener supplying unit 320 is provided with the siphon tube 314.

The siphon cap 280' forms the softener supplying unit 321 between the cover 282 and the top of the softener supplying unit 320.

The softener lid 290' is hinge-connected or detached to any one of the siphon cap 290' and the detergent box 254.

The effect of the detergent supply apparatus of the washing machine according to the present invention having the above-described structure is as follows.

In the detergent supply apparatus of the washing machine according to the present invention having the above-described structure, the softener lid opens and closes the softener injecting unit formed on the siphon, so that the detergent can be prevented from being infiltrated through the softener injecting unit of the siphon cap.

Also, in the detergent supply apparatus of the washing machine according to the present invention, the softener lid is hinge-connected to the siphon cap, so that the softener injecting unit can be opened and closed by means of a simple movement to lift up or down the softener lid, having an advantage of easiness in an opening and closing movement of the softener lid and an injection of the softener.

Also, in the detergent supply apparatus of the washing machine according to the present invention, the rib is provided on one side of the softener lid and the siphon cap and the detachable unit detaching the rib is provided on the siphon cap, so that the manufacturing thereof is easy.

Also, in the detergent supply apparatus of the washing machine according to the present invention, the softener lid or the siphon cap is provided with the handle, so that the operation thereof is easy in opening and closing the softener lid.

What is claimed is:

1. A detergent supply apparatus, comprising:

a detergent box in which a detergent supplying unit and a softener supplying unit are partitioned and formed, the softener supplying unit being provided with a siphon tube;

a siphon cap means covering the softener supplying unit and including a softener injecting unit; and a softener lid which is attached to the siphon cap means, the softener lid moving between open and closed positions relative to the softener injecting unit to expose an interior portion of the softener supplying unit independently from the detergent supplying unit, the softener lid opening the softener injecting unit through which softener is injected into the softener supplying unit, the softener lid closing the softener injecting unit to prevent the softener supplying unit from being infiltrated by water spattered from the detergent supplying unit.

2. The detergent supply apparatus as claimed in claim 1, wherein the detergent box is formed so that the detergent supplying unit includes a main detergent supplying unit and a preliminary detergent supplying unit, and the softener supplying unit is positioned between the main detergent supplying unit and the preliminary detergent supplying unit.

3. The detergent supply apparatus as claimed in claim 1, wherein the siphon cap means includes a cover covering the whole top of the softener supplying unit and a cap unit protruded from the bottom surface of the cover to surround the siphon tube.

4. The detergent supply apparatus as claimed in claim 3, wherein the cover is provided with a water supplying unit for supplying water to the softener supplying unit.

5. The detergent supply apparatus as claimed in claim 3, wherein the cap unit of the siphon cap protrudes at a position between the softener injecting unit and a water supplying unit.

6. The detergent supply apparatus as claimed in claim 1, wherein the softener lid is hinge-connected to the siphon cap means.

7. The detergent supply apparatus as claimed in claim 6, wherein a hinge pin is provided on one side of either the softener lid or the siphon cap means, and an axis supporting unit is provided for rotatably supporting the hinge pin.

8. The detergent supply apparatus as claimed in claim 1, wherein the softener lid is provided with a handle.

9. The detergent supply apparatus as claimed in claim 1, wherein a rib is provided on one side of either the softener lid or the siphon cap means, and a detachable unit is provided in which the rib is inserted in a removable way.

10. The detergent supply apparatus as claimed in claim 9, wherein the rib is protrudingly provided on a bottom side of the softener lid, and the detachable unit is provided on a top of the siphon cap means.

11. The detergent supply apparatus as claimed in claim 9, wherein the siphon cap means is provided with a handle groove around the detachable unit in order for a user to easily grasp the softener lid by his own hand.

12. A detergent supply apparatus of a washing machine, comprising:

a detergent box in which a detergent supplying unit and a softener supplying unit are partitioned and formed, the softener supplying unit being provided with a siphon tube;

a siphon cap means having an outlet path formed between the siphon tube and the siphon cap means;

a softener cover covering a top of the softener supplying unit and provided with a softener injecting unit; and a softener lid which is attached to the softener cover, the softener lid moving between open and closed positions relative to the softener injecting unit to expose an interior portion of the softener supplying unit independently from the detergent supplying unit, the softener lid opening the softener injecting unit through which softener is injected into the softener supplying unit, the softener lid closing the softener injecting unit to prevent the softener supplying unit from being infiltrated by water spattered from the detergent supplying unit.

13. The detergent supply apparatus of a washing machine as claimed in claim 12, wherein the softener cover is provided with a water supplying unit.

14. The detergent supply apparatus of a washing machine as claimed in claim 12, wherein the softener lid is hinge-connected to the softener cover.

15. The detergent supply apparatus of a washing machine as claimed in claim 12, wherein a rib is provided on one side of either the softener lid or the softener cover, and a detachable in which the rib is inserted in a removable way is provided on another side of either the softener lid or the siphon cap means.

16. A detergent supply apparatus of a washing machine, comprising:

a detergent box in which a detergent supplying unit and a softener supplying unit are partitioned and formed, the softener supplying unit being provided with a siphon tube;

a siphon cap means having a portion opened toward a top of the softener supplying unit and an outlet path formed between the siphon tube and the siphon cap; and a softener lid which is attached to the siphon cap means, the softener lid moving between open and closed positions relative to the opened portion to expose an interior portion of the softener supplying unit independently from the detergent supplying unit, the softener lid opening the opened portion through which softener is injected into the softener supplying unit, the softener lid closing the softener injecting unit to prevent the softener supplying unit from being infiltrated by water spattered from the detergent supplying unit.

17. The detergent supply apparatus of a washing machine as claimed in claim 16, the siphon cap means includes a cover covering a part of the top of the softener supplying unit; and a cap unit protruded from the bottom surface of the cover to surround the siphon tube.

18. The detergent supply apparatus of a washing machine as claimed in claim 17, wherein the cover is provided with a water supplying unit.

19. The detergent supply apparatus of a washing machine as claimed in claim 16, wherein the softener lid is hinge-connected to the siphon cap means.

20. The detergent supply apparatus of a washing machine as claimed in claim 16, wherein a rib is provided on one side of either the softener lid or the siphon cap means, and a detachable unit in which the rib is inserted in a removable way the rib is provided on another side of either the softener lid or the siphon cap means.

21. A detergent supply apparatus, comprising:

a detergent box in which a detergent supplying unit and a softener supplying unit are partitioned and formed, the softener supplying unit being provided with a siphon tube;

a siphon cap covering the softener supplying unit and including a softener injecting unit; and a softener lid which is attached to the siphon cap, the softener lid moving between open and closed positions relative to the softener injecting unit to expose an interior portion of the softener supplying unit independently from the detergent supplying unit, the softener lid opening the softener injecting unit through which softener is injected into the softener supplying unit, the softener lid closing the softener injecting unit to prevent the softener supplying unit from being infiltrated by water spattered from the detergent supplying unit, wherein:

the softener lid is attached to an upper surface of the siphon cap and opens and closes relative to the softener injecting unit, the siphon cap is substantially coextensive in size with the softener supplying unit to cover the interior of the softener supplying unit, and a complementary tube extends from a lower surface of the siphon cap at a predetermined angle to cover the siphon tube, the complementary tube having a diameter different from a diameter of the siphon tube.

22. The detergent supply apparatus as claimed in claim 21, wherein said predetermined angle is substantially 90°.

23. The detergent supply apparatus as claimed in claim 21, wherein the complementary tube has a diameter larger than the diameter of the siphon tube.

24. The detergent supply apparatus as claimed in claim 21, wherein the upper surface of the siphon cap includes a water supplying opening to allow water to flow therethrough relative to the interior of the softener supplying unit.

25. The detergent supply apparatus as claimed in claim 24, wherein the complementary tube separates the water supplying opening from the opening covered by the softener lid, the water supplying opening and the opening covered by the softener lid locating on opposing sides of the upper surface of the siphon cap.

* * * * *